US007077300B1

(12) United States Patent
Di Pietro

(10) Patent No.: US 7,077,300 B1
(45) Date of Patent: Jul. 18, 2006

(54) ADJUSTABLE CLOTHES HANGER

(76) Inventor: Gerda W. Di Pietro, 114 Bear Wallow Indian Camp Mountain, Rosman, NC (US) 28772

( * ) Notice: Subject to any disclaimer, the term of this patent is extended or adjusted under 35 U.S.C. 154(b) by 0 days.

(21) Appl. No.: 10/926,199

(22) Filed: Aug. 26, 2004

(51) Int. Cl.
*A41D 27/22* (2006.01)

(52) U.S. Cl. ..... 223/89; 223/94

(58) Field of Classification Search ..... 223/85, 223/89, 94, 98
See application file for complete search history.

(56) References Cited

U.S. PATENT DOCUMENTS

| | | | | | |
|---|---|---|---|---|---|
| 2,637,471 | A | * | 5/1953 | Goldschmidt et al. | 223/89 |
| 2,640,632 | A | * | 6/1953 | Price | 223/89 |
| 2,699,276 | A | | 1/1955 | Goodman | |
| 2,814,426 | A | | 11/1957 | Miller | |
| 2,900,117 | A | * | 8/1959 | Veltry | 223/94 |
| 3,005,579 | A | * | 10/1961 | Thurber | 223/89 |
| 3,254,814 | A | * | 6/1966 | Weir et al. | 223/89 |
| 3,874,572 | A | | 4/1975 | McClenning | |
| 4,895,283 | A | * | 1/1990 | Evangelist et al. | 223/94 |
| D320,313 | S | | 10/1991 | Gatling | |
| 5,085,358 | A | * | 2/1992 | Lam | 223/94 |
| 5,129,557 | A | * | 7/1992 | Kolton et al. | 223/91 |
| 5,397,038 | A | * | 3/1995 | Hunt | 223/95 |
| 5,476,199 | A | * | 12/1995 | Halverson et al. | 223/94 |
| 5,598,957 | A | | 2/1997 | Bell | |
| 5,680,972 | A | * | 10/1997 | Clarke | 223/88 |
| 5,727,718 | A | * | 3/1998 | Lam | 223/94 |
| 5,941,429 | A | * | 8/1999 | Koons | 223/94 |
| 6,021,932 | A | * | 2/2000 | Lam | 223/94 |
| 6,068,166 | A | * | 5/2000 | Kilian et al. | 223/94 |
| 6,158,634 | A | * | 12/2000 | Kelroy | 223/89 |
| 6,179,174 | B1 | | 1/2001 | Kandl | |
| 6,409,058 | B1 | * | 6/2002 | Lam et al. | 223/94 |
| 6,637,630 | B1 | * | 10/2003 | Rivenburgh | 223/85 |
| 6,644,520 | B1 | * | 11/2003 | Lam | 223/94 |
| 6,688,503 | B1 | * | 2/2004 | Viazanko et al. | 223/89 |
| 6,722,538 | B1 | * | 4/2004 | Autry et al. | 223/94 |
| 6,811,064 | B1 | * | 11/2004 | Salem | 223/94 |

* cited by examiner

*Primary Examiner*—Gary L. Welch

(57) ABSTRACT

An adjustable clothes hanger includes a shaft and a plurality of arms slidably positionable therealong. Such a plurality of arms include core sections provided with grooves for receiving the shaft therethrough, respectively. The grooves extend along a length of the arms, thereby making the arms movable between retracted and extended positions for adjusting a length of the hanger. Advantageously, each core section is provided with a closed end portion laterally spaced from the center of the hander for defining a maximum distance along which the plurality of arms can be transferred. The hanger further includes a hook for engaging a support surface so that the hanger can conveniently be maintained at a stable position during operating conditions.

18 Claims, 2 Drawing Sheets

ADJUSTABLE CLOTHES HANGER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a clothes hanger and, more particularly, to an adjustable clothes hanger for accommodating various styles and sizes of garments.

2. Prior Art

Currently, there exist hangers to fit various size clothing to allow a person to store their clothes efficiently and without the necessity of folding. There does not exist, however, a hanger to accommodate larger sized adult clothes or a hanger to accommodate varying smaller sized clothes as those for infants, toddlers and older children. Traditional clothing sizes for larger adult clothes range from size thirty-two (32), having a width of sixteen inches (16") to size seventy (70), having a width of thirty-five inches (35"). A standard hanger is seventeen inches (17") wide and accommodates adult clothing sizes thirty-two (32) and smaller. While some larger sized hangers exist for sizes thirty-four (34) to fifty-two (52), there are currently no hangers for adult clothing sizes fifty-four (54) and above.

One problem encountered with using an inappropriately sized hanger with larger adult sizes is that the clothes are difficult to hang and frequently fall off the hanger because of the larger neck opening. In a retail clothes store this is especially bothersome because the larger sized clothes get dirty, wrinkled and is even stepped upon once they fall on the ground.

Another problem is that the ends of the hanger cause deformities in the fabric of the clothes being hung. Once a deformity appears, it is hard to remove and this may leave the clothing unwearable.

Accordingly, a need remains for an adjustable hanger that as easy to use, cost-effective and durable. Such an adjustable hanger allows an individual to hang up clothes of varying styles and sizes without having to worry about wrinkles, creases and dimples forming in the fabric. The present invention satisfies such a need by providing an adjustable hanger for conveniently accommodating heavy jackets and sweaters, which must usually be folded thereby causing unsightly creases.

BRIEF SUMMARY OF THE INVENTION

In view of the foregoing background, it is therefore an object of the present invention to provide an adjustable clothes hanger. These and other objects, features, and advantages of the invention are provided by an adjustable clothes hanger for accommodating the style and size of various garments. The hanger includes an elongated shaft, preferably formed from plastic, which has a centrally disposed longitudinal axis and opposed end portions spaced apart at a predetermined distance. The shaft further has substantially planar outer wall portions equally spaced along the axis and extending along a length of the shaft.

The apparatus also includes a plurality of arms preferably formed from plastic and including a plurality of core sections disposed therein. Such core sections are provided with corresponding grooves for telescopically receiving the shaft respectively. The plurality of grooves extend substantially parallel to the axis and along a length of the plurality of arms respectively. Such a plurality of arms are selectively movable along the axis between retracted and extended positions for advantageously adjusting a length of the hanger. Each of the plurality of core sections preferably have one closed end portion laterally spaced from the hook for effectively defining a distance along which the plurality of arms may be moved.

The plurality of arms may further include outer end portions that have a generally arcuate shape directed downwardly from the shaft. Such arms may further have an exterior covering formed from padded material. In one embodiment, a plurality of hook members may be attached to the arcuate outer end portions, extending downwardly and away therefrom.

In an alternate embodiment, the hanger may further include an adjustable rod member that has opposed end portions connected to the arcuate outer end portions, which extend substantially parallel to the axis.

The present invention further includes a hook disposed substantially medially of the shaft and extending vertically upwardly therefrom for engaging a support surface so that the hanger can conveniently be maintained at a substantially stable position during operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
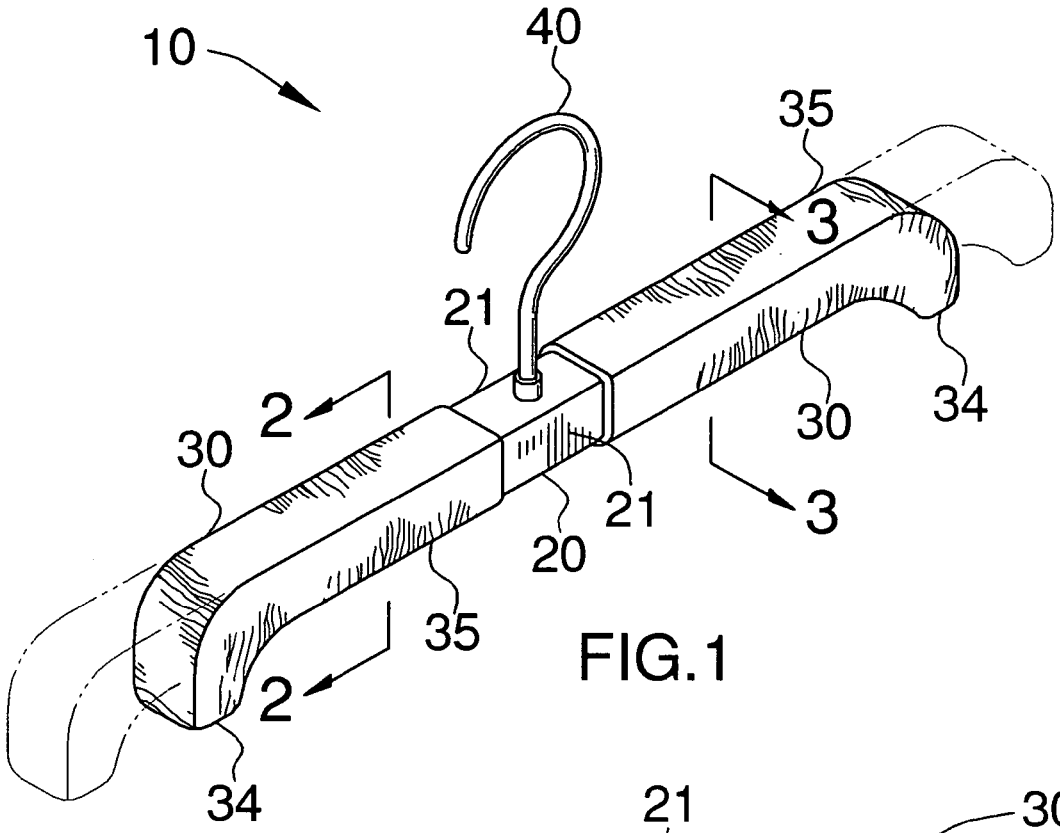
FIG. 1 is a perspective view showing an apparatus for and adjustable clothes hanger, in accordance with the present invention.
Figure 2:
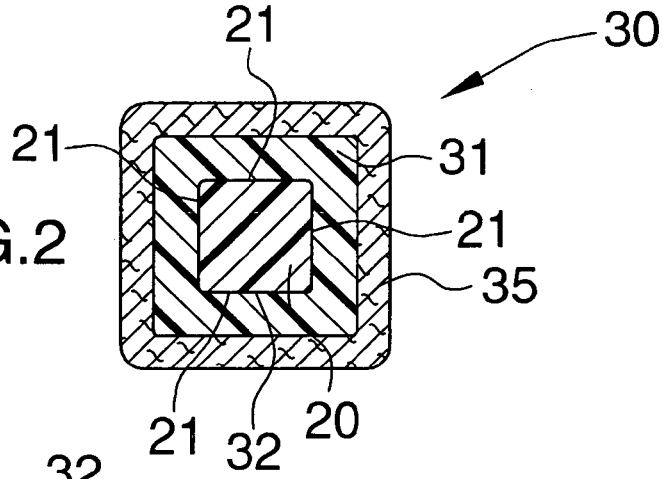
FIG. 2 is a cross-sectional view of the apparatus shown in FIG. 1, taken along line 2—2.
Figure 3:
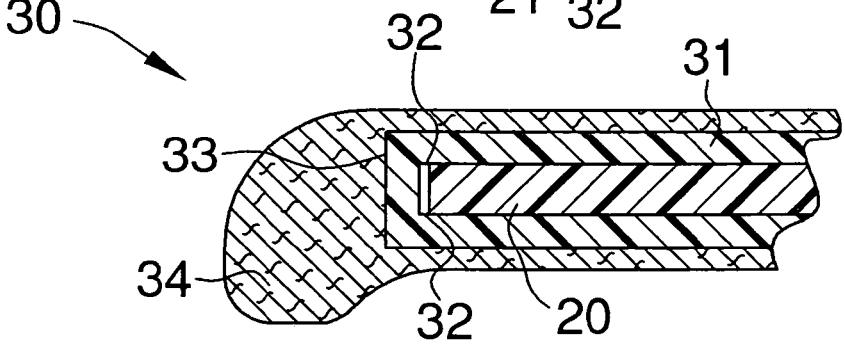
FIG. 3 is an enlarged cross-sectional view of the apparatus shown in FIG. 1, taken along line 3—3.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures. Prime/double prime notations refer to alternate embodiments of like elements.

The apparatus of this invention is referred to generally in FIGS. 1–5 by the reference numeral 10 and is intended to provide an adjustable clothes hanger. It should be understood that the apparatus 10 may be used to suspend many different types of garments and should not be limited to only conventional pants or shirts.

Referring initially to FIG. 1, the apparatus 10 includes an elongated shaft 20, preferably formed from plastic, which has a centrally disposed longitudinal axis and opposed end portions spaced apart at a predetermined distance. The shaft 20 further has substantially planar outer wall portions 21 equally spaced along the axis and extending along a length of the shaft 20.

The apparatus 10 also includes a plurality of arms 30 formed from plastic and including a plurality of core sections 31 disposed therein. Construction from plastic imparts strength to the hanger 10, while keeping the cost of production low, thus effectively lowering the selling price making the apparatus 10 cost effective. Such core sections 31 are provided with corresponding grooves 32 for telescopically receiving the shaft 20 respectively.

The plurality of grooves 32 extend substantially parallel to the axis and along a length of the plurality of arms 30 respectively. Such a plurality of arms 30 are selectively movable along the axis between retracted and extended positions for advantageously adjusting a length of the hanger 10 in order to accommodate clothing apparel of various styles and sizes, while preventing unsightly creases from forming in the material. Each of the plurality of core sections 31 has one closed end portion 33 laterally spaced from the hook 40 for effectively defining a distance along which the plurality of arms 30 is moveable.

Figure 4:
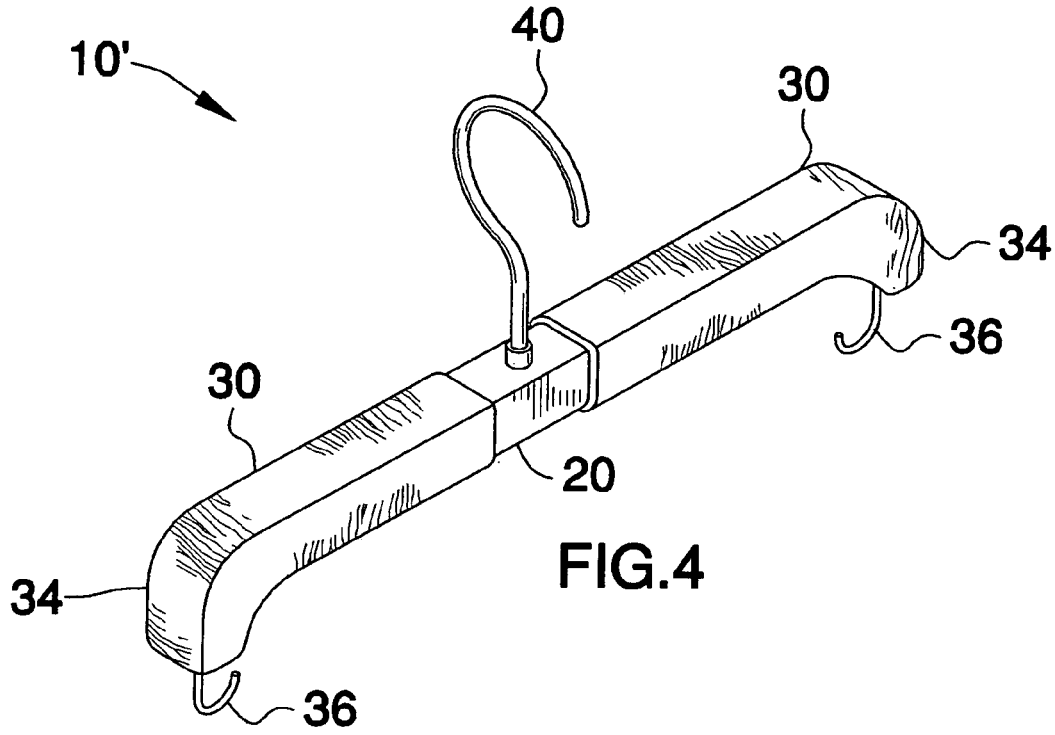
FIG. 4 is a perspective view showing a preferred embodiment wherein the present invention is provided with the plurality of hook members attached thereto.

The plurality of arms 30 further include outer end portions 34 that have a generally arcuate shape directed downwardly from the shaft 20. Such arms 30 further have an exterior covering 35 formed from padded material. The exterior covering 35 conveniently helps prevent creases from forming in the clothing suspended from the hanger 10. As can be seen in FIG. 4, in one embodiment 10', a plurality of hook members 36 is attached to the arcuate outer end portions 34, extending downwardly and away therefrom. Such a plurality of hook members 36 advantageously allows a skirt to be hung simultaneously with a shirt, sweater or jacket. This effectively saves closet space for alternate use.

Figure 5:
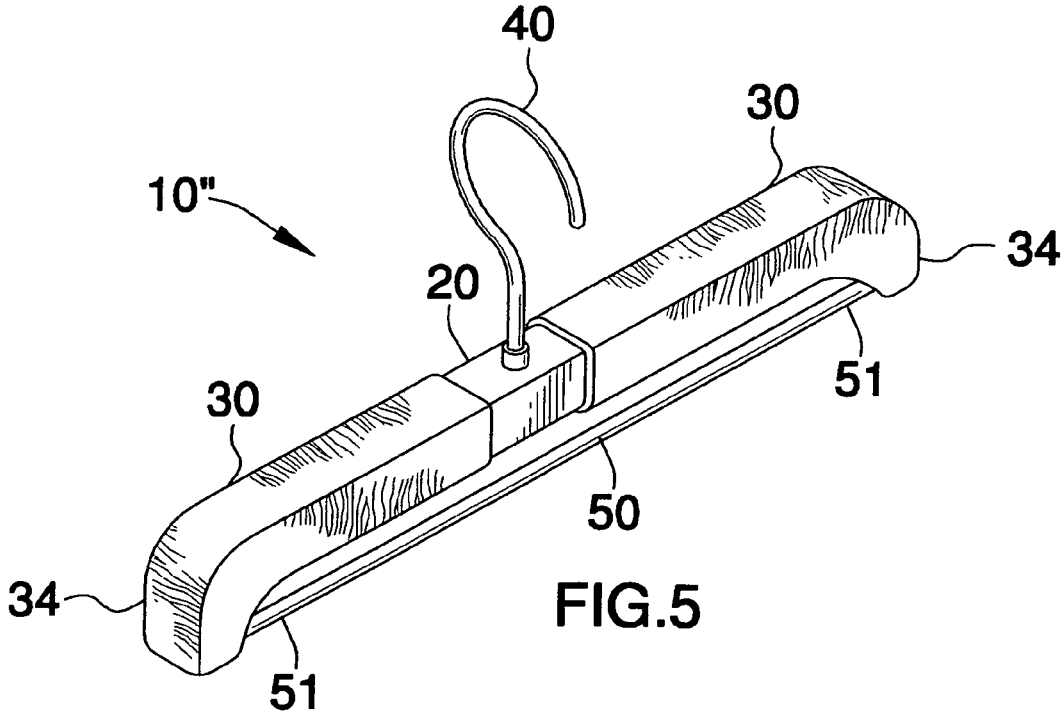
FIG. 5 is a perspective view showing an alternate embodiment wherein the present invention is provided with an adjustable rod attached thereto.

In an alternate embodiment 10", illustrated in FIG. 5, the hanger 10 includes an adjustable rod member 50 that has opposed end portions 51 connected to the arcuate outer end portions 34, which extend substantially parallel to the axis. Such an adjustable rod member 50 advantageously allows a pair of pants or neck ties to be hung simultaneously with a shirt, sweater or jacket. This effectively saves closet space for alternate use.

As shown in FIGS. 1, 4 and 5 the present invention further includes a hook 40 disposed substantially medially of the shaft 20 and extending vertically upwardly therefrom for engaging a support surface (not shown) so that the hanger 10 can conveniently be maintained at a substantially stable position during operating conditions. Advantageously, the hook 40 further allows the hanger 10 to be slidably adjusted along a support surface (not shown) in order to gain easy access to the clothing suspended therefrom.

The hanger 10 can be constructed in a wide variety of colors to advantageously accommodate an individual's coloring scheme in their home, and effectively increases the appeal of the apparatus 10.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An adjustable clothes hanger for accommodating the style and size of garments, said hanger comprising:

an elongated shaft having a centrally disposed longitudinal axis and opposed end portions spaced apart at a predetermined distance, said shaft further having substantially planar outer wall portions equally spaced along the axis and extending along a length of said shaft;

a plurality of arms comprising a plurality of core sections disposed therein and being provided with corresponding grooves for telescopically receiving said shaft respectively, the plurality of grooves extending substantially parallel to the axis and along a length of said plurality of arms respectively, said plurality of arms being selectively movable along the axis between retracted and extended positions for adjusting a length of said hanger; and a hook disposed substantially medially of said shaft and extending vertically upwardly therefrom, said hook for engaging a support surface so that said hanger can be maintained at a substantially stable position during operating conditions.

2. The hanger of claim 1, wherein said plurality of arms further comprise:

outer end portions having a generally arcuate shape directed downwardly from said shaft.

3. The hanger of claim 2, further comprising: a plurality of hook members attached to said arcuate outer end portions and extending downwardly and away therefrom.

4. The hanger of claim 2, further comprising: an adjustable rod member having opposed end portions connected to said arcuate outer end portions and extending substantially parallel to the axis.

5. The hanger of claim 1, wherein said shaft and said plurality of arms are formed from plastic material.

6. The hanger of claim 1, wherein said plurality of arms have an exterior covering formed from padded material.

7. The hanger of claim 1, wherein each said plurality of core sections have one closed end portion laterally spaced from said hook and for defining a distance along which said plurality of arms may be moved.

8. An adjustable clothes hanger for accommodating the style and size of garments, said hanger comprising:

an elongated shaft having a centrally disposed longitudinal axis and opposed end portions spaced apart at a predetermined distance, said shaft further having substantially planar outer wall portions equally spaced along the axis and extending along a length of said shaft;

a plurality of arms comprising a plurality of core sections disposed therein and being provided with corresponding grooves for telescopically receiving said shaft respectively, each said plurality of core sections having one closed end portion laterally spaced from said hook and for defining a distance along which said plurality of arms may be moved, the plurality of grooves extending substantially parallel to the axis and along a length of said plurality of arms respectively, said plurality of arms being selectively movable along the axis between retracted and extended positions for adjusting a length of said hanger; and a hook disposed substantially medially of said shaft and extending vertically upwardly therefrom, said hook for engaging a support surface so that said hanger can be maintained at a substantially stable position during operating conditions.

9. The hanger of claim 8, wherein said plurality of arms further comprise: outer end portions having a generally arcuate shape directed downwardly from said shaft.

10. The hanger of claim 9, further comprising: a plurality of hook members attached to said arcuate outer end portions and extending downwardly and away therefrom.

11. The hanger of claim 9, further comprising: an adjustable rod member having opposed end portions connected to said arcuate outer end portions and extending substantially parallel to the axis.

12. The hanger of claim 8, wherein said shaft and said plurality of arms are formed from plastic material.

13. The hanger of claim 8, wherein said plurality of arms have an exterior covering formed from padded material.

14. An adjustable clothes hanger for accommodating the style and size of garments, said hanger comprising:

an elongated shaft having a centrally disposed longitudinal axis and opposed end portions spaced apart at a predetermined distance, said shaft further having substantially planar outer wall portions equally spaced along the axis and extending along a length of said shaft;

a plurality of arms comprising a plurality of core sections disposed therein and being provided with corresponding grooves for telescopically receiving said shaft therein respectively, each said plurality of core sections having one closed end portion laterally spaced from said hook and for defining a distance along which said plurality of arms may be moved, the plurality of grooves extending substantially parallel to the axis and along a length of said plurality of arms respectively, said plurality of arms being selectively movable along the axis between retracted and extended positions for adjusting a length of said hanger, said plurality of arms further comprising outer end portions having a generally arcuate shape directed downwardly from said shaft; and a hook disposed substantially medially of said shaft and extending vertically upwardly therefrom, said hook for engaging a support surface so that said hanger can be maintained at a substantially stable position during operating conditions.

15. The hanger of claim 14, wherein said shaft and said plurality of arms are formed from plastic material.

16. The hanger of claim 14, wherein said plurality of arms have an exterior covering formed from padded material.

17. The hanger of claim 14, further comprising: a plurality of hook members attached to said arcuate outer end portions and extending downwardly and away therefrom.

18. The hanger of claim 14, further comprising: an adjustable rod member having opposed end portions connected to said arcuate outer end portions and extending substantially parallel to the axis.

* * * * *